US005328421A

United States Patent [19]

Stanalajczo

[11] Patent Number: 5,328,421

[45] Date of Patent: Jul. 12, 1994

[54] CLOSED KINETIC CHAIN EXERCISE DEVICE AND METHOD

[76] Inventor: Charles G. Stanalajczo, 2215 Winston, Sterling Heights, Mich. 48310

[21] Appl. No.: 135,456

[22] Filed: Oct. 12, 1993

[51] Int. Cl.[5] ..... A63B 23/04

[52] U.S. Cl. ..... 482/34; 482/79

[58] Field of Search ..... 482/34, 79, 80, 146, 482/147, 140, 142; 472/106, 108, 115

[56] References Cited

U.S. PATENT DOCUMENTS

| | | | |
|---|---|---|---|
| 2,253,996 | 8/1941 | Bechman | 272/51 |
| 3,416,792 | 12/1968 | Morgan et al. | 272/60 |
| 4,505,477 | 3/1985 | Wilkinson | 272/146 |
| 4,653,748 | 3/1987 | Seel et al. | 482/79 |
| 4,759,542 | 7/1988 | Hudec | 482/34 |
| 4,822,039 | 4/1989 | Gonzales et al. | 272/146 |
| 4,911,440 | 3/1990 | Hyman et al. | 482/34 |
| 5,152,691 | 10/1992 | Moscarello | 482/34 |

*Primary Examiner*—Stephen R. Crow

*Attorney, Agent, or Firm*—Reising, Ethington, Barnard, Perry & Milton

[57] ABSTRACT

A rehabilitation device for conditioning the lower extremity joints of a user includes a platform having an upper surface with spaced apart enhanced friction regions for stabilizing the users feet on a variety of side to side locations on the platform whereby tipping movements about a pivot plate connected to the platform will produce a closed chain kinetic exercising of such joints.

7 Claims, 2 Drawing Sheets

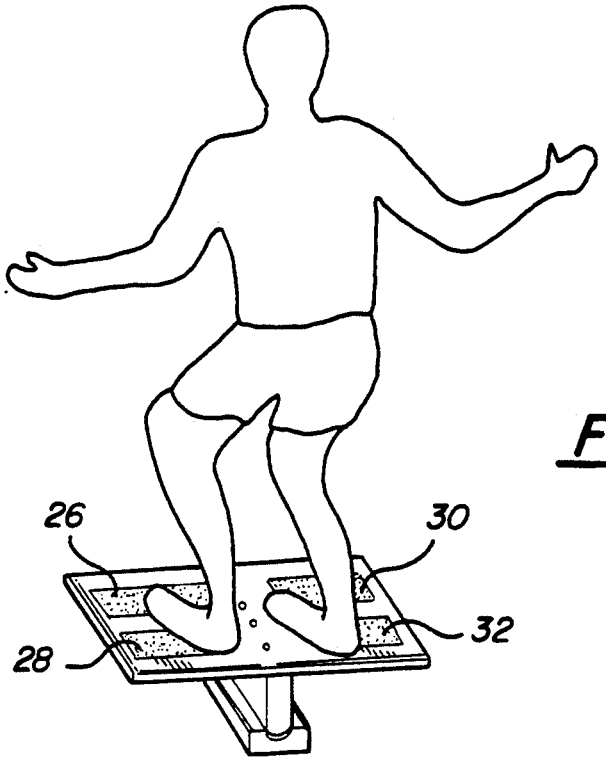
FIG-7
FIG-8
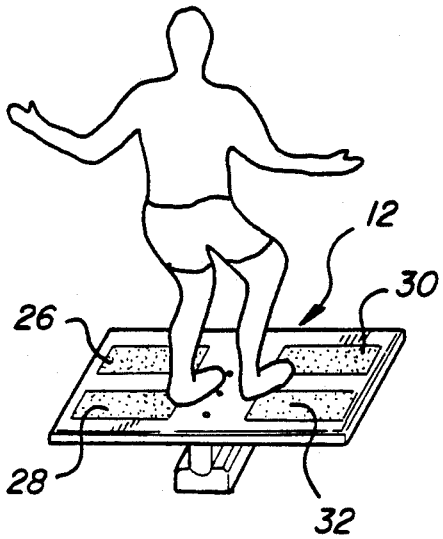
FIG-9
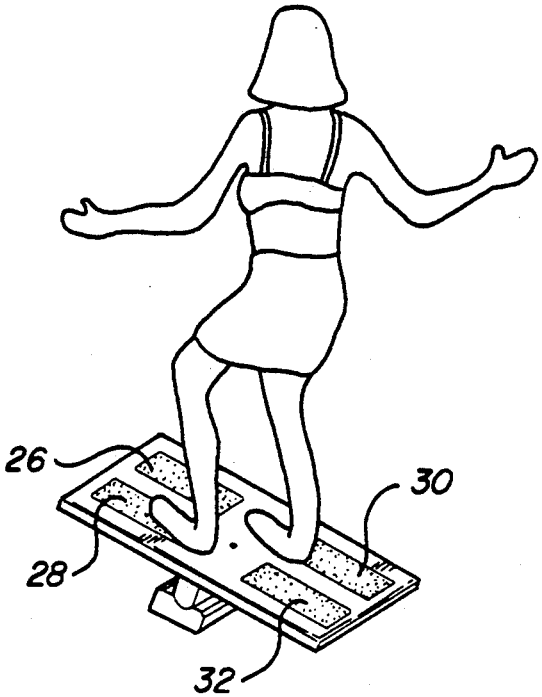

CLOSED KINETIC CHAIN EXERCISE DEVICE AND METHOD

TECHNICAL FIELD

This invention relates generally to exercise devices and, in particular to physical therapy exercise devices for manipulating a patients joints with closed kinetic chain exercises.

BACKGROUND OF THE INVENTION

Various devices have been suggested for physical rehabilitation.

U.S. Pat. No. 4,822,039 discloses a single foot platform having a pivot member on the underside thereof located between the heel and toe of a single foot of the user. The '039 patent provides for a tipping movement from the heel to the toe. While satisfactory for its intended purpose the device shown in the '039 patent does not provide for a closed kinetic chain exercise that will rehabilitate oppositely located lower extremity joints.

Exercising devices are shown in U.S. Pat. Nos. 2,253,996 to Bechman, U.S. Pat. No. 3,416,792 to Morgan et al and U.S. Pat. No. 4,505,477 to Wilkinson all of which are representative of balancing exercisers having a platform and a center mounted pivot member. In the '996 and the '792 patents the platform is a narrow member (fore to aft) that has outwardly located platform surfaces for a user's feet that require a wide separation of the users feet. The platform surfaces do not provide for positioning of a user's feet on opposite sides of a pivot point at a variety of side-to-side and fore and aft positions. Accordingly, the feet of a user cannot be positioned to produce an optimum closed kinetic chain exercise of different pairs of joints for patients having wide variety of heights and weights. The '477 patent requires a complex spring and wheel system to produce side to side rolling and tilting movement. It discloses only two foot pads that are limited in area and spaced a substantial distance from the center of the platform.

None of the aforesaid devices provide an exerciser upon which a patient's can be positioned in a variety of side to side and front to rear positions on a support platform and wherein the support platform can be connected to a pivot plate of varying height to vary the kinetic motion required for a particular joint rehabilitation.

SUMMARY OF THE INVENTION

The above-noted shortcoming of prior art balance devices are overcome in the present invention, which, in one aspects comprises a support platform having side to side and front to rear enhanced friction surfaces arranged to position the feet of a patient with each foot on one side of a pivot plate in a variety of locations on either side and along the length of a pivot plate. The pivot plate is connected on the underside of the support platform by suitable fasteners such as screws. The pivot plate has a height that is selected to produce a predetermined angular movement that will translate into a desired manipulation of a particular pair of joints depending upon the positioning of the patients feet at fore and aft and side to side locations on the enhanced friction surfaces. In a preferred embodiment, a pivot platform is provided for the pivot plate. The pivot platform has a length along which a curved surface is formed to receive a congruent curved surface on the pivot plate for allowing lateral sliding movement of the pivot plate within the pivot platform such that the support platform can be tilted about the pivot platform and balanced thereon. A lock member is directed through the pivot plate and the support platform intermediate the opposite ends thereof intersecting the curved surfaces to interlock them against fore and aft movement therebetween without constraining pivoting movement therebetween.

A further aspect of the present invention is a method for close kinetic exercising of oppositely located lower extremity joints including the steps of: selecting a pair of oppositely located lower extremity joints to be exercised; spatially separating the feet of a patient apart a distance corresponding to the selected joint; arranging spatially separated feet generally parallel to one another and either parallel to or obliquely of a center line between feet; stabilizing the feet in the selected parallel or oblique position; selectively raising and lowering the feet by tilting them together about the center line for imposing variable force on the lower extremity joint to be exercised.

BRIEF DESCRIPTION OF THE DRAWINGS

A preferred exemplary embodiment of the present invention will hereinafter be described in conjunction with the appended drawings, wherein like designations denote like elements, and:

FIG. 7 is a diagrammatic view showing an adult male positioned on an embodiment of the present invention configured for a maximum angular closed kinetic chain exercising of the knee joints;

FIG. 8 is a diagrammatic view showing a child positioned on an embodiment of the present invention configured for a closed kinetic chain exercising of the ankle joints; and FIG. 9 is a diagrammatic view show an adult female positioned on an embodiment of the present invention configured for a closed chain exercising of the hip joints.

DETAILED DESCRIPTION OF THE PREFERRED EMBODIMENT

Figure 1:
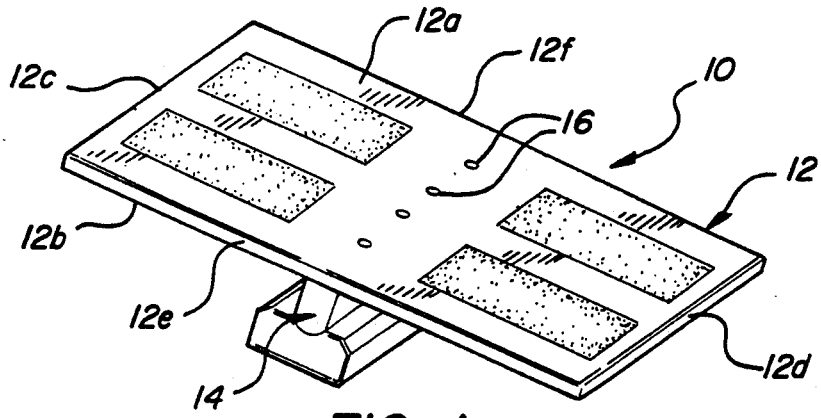
FIG. 1 is a perspective view of the present invention.
Figure 2:
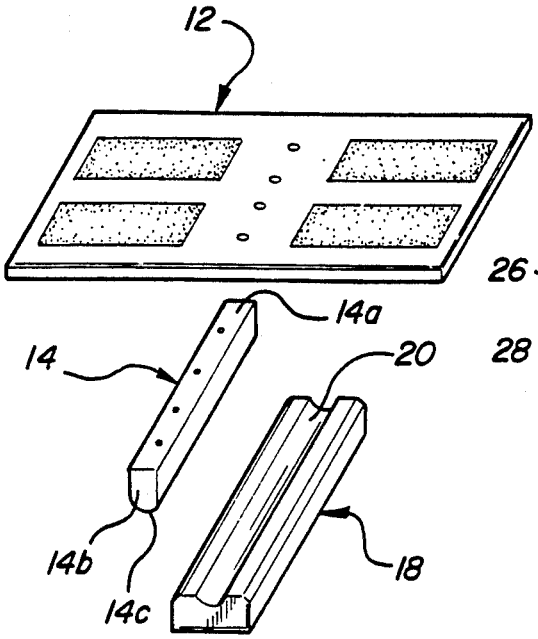
FIG. 2 is an exploded view showing the main component parts embodied in the perspective view of FIG. 1.

As shown in FIG. 1, a closed chain exerciser device 10 includes a platform 12 having a rectangular upper surface **12*a* and a rectangular lower surface 12*b*. While a rectangular shape is illustrated the platform can have other geometric shapes so long as it is configured to have sufficient surface area for friction surfaces to be described. In the illustrated embodiment, the platform 12 has side edges 12*c*, 12*d* and fore and aft edges 12*e* and 12*f***.

The platform 12 is connected to a pivot plate 14 that has a length substantially equal to the distance between the fore and aft edges **12*e* and 12*f*. The pivot plate 14 has a flat upper edge 14*a* and a distal end 14*b* that is formed with a semi-circular surface 14c for purposes to be discussed. The flat upper surface 14a is disposed along the lower surface 12b midway of the side edges 12c, 12d where it is connected to the platform 12 by a plurality of fasteners 16** shown as wood screws. The connection can also be made by adhesive or other suitable fasteners.

The height of the pivot plate 14 is selected so that the upper surface 12a of the platform 12 will have a given tilt angle on either side of the pivot plate 14 when an imbalanced force is imposed on the platform 12. When the platform 12 has balancing forces thereon, it will be located at a zero tilt angle, e.g., the platform 12 will be parallel to an underlying floor or ground.

In order to stabilize the fore and aft position of the platform, a pivot plate platform 18 is provided. The pivot plate platform 18 has a recess 20 formed along the length thereof. The length of the platform 18 is substantially equal to the length of the pivot plate 14. The recess has a curved surface 20a that is congruent to the semi-circular surface 14c of the pivot plate. The recess is intersected by a bore 22 through the platform 18 at a location midway of its length. The bore 22 receives a cross-member or lock-pin 24. The lock-pin is interlocked within a groove 25 formed in the distal end 14c of the pivot plate 14 at the mid-point between the ends thereof. The lock-pin 24 serves to prevent fore and aft relative movement between the platform and the pivot plate during closed kinetic chain exercises to be described.

An important feature of the present invention is an array of surface regions on the upper surface 12a that are configured to provide a wide range of foot segment stabilization locations depending upon the kind of therapy to be practiced on the closed kinetic chain exerciser 10.

Figure 3:
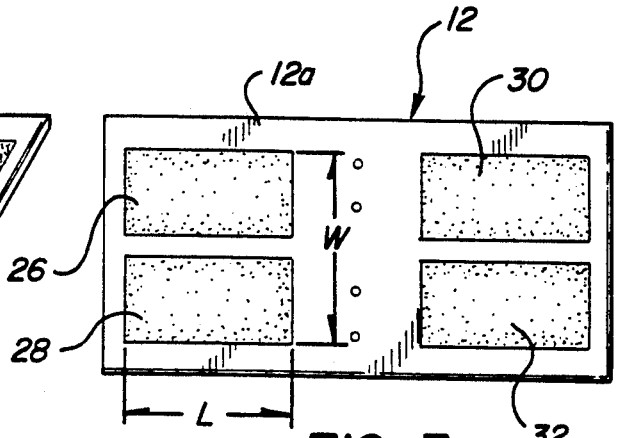
FIG. 3 is a top elevational view of a support platform of the present invention.
Figure 5:
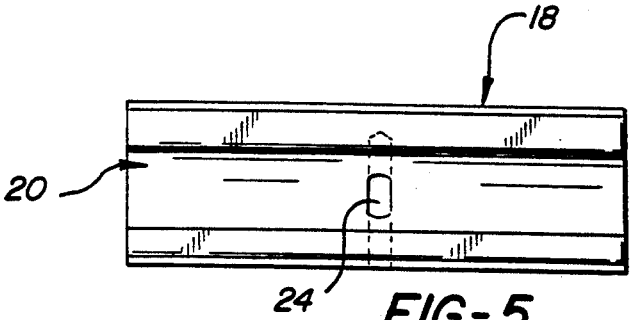
FIG. 5 is a top elevational view of a pivot plate support of the present invention.
Figure 4:
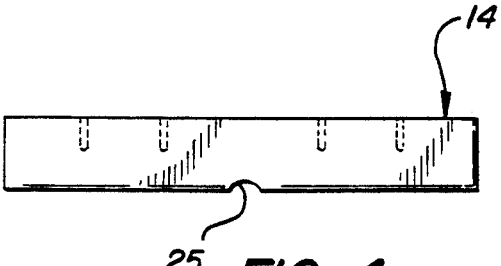
FIG. 4 is a side elevational, view of a pivot plate of the present invention.
Figure 6:
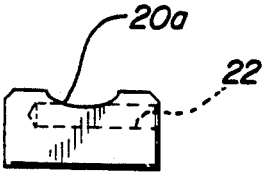
FIG. 6 is an end elevational view of the pivot plate support of FIG. 5 looking in the direction of the arrow 6 in FIG. 5.

As best seen in FIG. 3, surface regions 26, 28, 30 and 32 are formed as first and second enhanced friction surfaces 26, 28 and 30, 32 on said upper surface 12a with the first friction surface 26, 28 located on the upper surface solely on one side of the pivot plate 14. Likewise, the second friction surfaces 30, 32 are located on the opposite side of the pivot plate 14. By virtue of this arrangement the user's feet can be located on the upper surface 12a in a variety of positions on surfaces of friction greater than that of upper surface 12a. The surfaces 26, 28 and 30, 32 combine to define a side-to-side length L and a front-to rear width W that permits each foot of a patent to be stabilized at a location on the platform 12 on either side of the pivot plate with the feet being moveable from a position adjacent the center of the platform to a position closely adjacent the sides 12c, 12d and still have frictional contact with one of the surfaces 26, 28, 30, 32. In the illustrated arrangement the dimensions of each of the friction surfaces 26, 28, 30 and 32 are typically eight inches in length and four inches wide; their front to rear edge spacing is 1 and ⅜ inches; their side edge spacing is 1 inch and their spacing from the center of the platform is 3 inches. While these dimensions have been found to provide desired frictional contact between the feet in a variety of positions on either side of the center of the platform they are only cited as being exemplary of a suitable arrangement to provide frictional engagement for stabilizing the feet when they are located close to the center of the platform as well as when they are located close to the side edges of the platform.

The present invention thus provides an arrangement wherein the feet can be located in a variety of locations to be discussed such that a patient can be subjected to a number of different closed kinetic chain exercises of selected lower extremity joints.

The friction surfaces 26, 28, 30 and 32 can be formed as pads of abrasive material having grit or sand particles embedded in a suitable matrix material. The particles are exposed to enhance the frictional resistance of the pads and the matrix material can be secured to the upper surface 12a by suitable adhesive material. Other suitable friction surfaces include rubber, silicone coatings, woven metallic fibers such as steel wool or woven copper; woven synthetic fibers and the like. In the case of solid frictional material the surfaces 26, 28, 30 and 32 can be either plain or embossed with a knurled pattern depending upon the frictional aggressiveness that is desired.

In FIG. 7, an adult male's feet are positioned so that one foot is one the first friction surfaces 26, 28 and the other foot is positioned on the second friction surfaces 30, 32 at a lateral spacing therebetween that produces a maximum angular closed kinetic chain exercising of the knee joints.

FIG. 8 shows a child's feet positioned so that one foot is on the first friction surfaces 26, 28 and the other foot is positioned on the second friction surfaces 30, 32 such that both feet are closely proximate to the center of the platform 12 and at a lateral spacing therebetween that is selected, taking into account the length of the child's lower extremities, such that the tilting movement of the platform 12 will produce a closed kinetic chain exercising of the ankle joints.

FIG. 9 shows a woman's feet positioned so that one foot is one the first friction surfaces 26, 28 and the other foot is positioned on the second friction surfaces 30, 32 at a lateral spacing and oblique angular relationship with respect to the pivot plate 14 therebetween that is selected, taking into account the length of the woman's lower extremities, such that the tilting movement of the platform 12 will produce a closed kinetic chain exercising of the hip joints.

Another feature of the present invention is that the pivot plate 14 can have a height that will vary the degree of tilt for a particular closed kinetic chain exercise. In such case the different height pivot plate 14', shown in the embodiment of FIG. 7, can be substituted for the pivot plate 14 shown in FIGS. 1–6, 8 and 9.

The present invention thus additionally contemplates a method for close kinetic exercising of oppositely located lower extremity joints including the steps of: selecting a pair of oppositely located lower extremity joints to be exercised; spatially separating the feet of a patient apart a distance corresponding to the selected joint; arranging spatially separated feet generally parallel to one another and either parallel to or obliquely of a center line between feet; locking the feet in the selected parallel or oblique position; selectively raising and lowering the feet by tilting them together about the center line for imposing variable force on the lower extremity joint to be exercised.

Thus I have provided a CLOSED KINETIC CHAIN EXERCISE DEVICE which fully satisfies the objects, aims and advantage set forth herein. While the invention has been described in connection with a specific embodiment thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. A closed kinetic chain exerciser device comprising:

a platform having an upper surface and a lower surface;

a pivot plate support having a length substantially equal to the distance between the front and rear edges of said platform and including a semi-circular recess therein for supporting said distal end of said pivot plate during opposite tilting movement of said platform;

a cross-member on said pivot plate support and an opening in said pivot plate for receiving said cross-member for preventing fore and aft movement of said platform with respect to said pivot plate support for preventing separation therebetween along the length thereof during tilting movement of said platform;

a pivot plate connected to said lower surface;

first and second friction surfaces on said upper surface having a coefficient of friction greater than that of said upper surface; said first friction surface located on said upper surface solely on one side of said pivot plate; said second friction surface located on said upper surface solely on a side of said pivot plate opposite to said one side; said first and second friction surfaces having dimensions including a side-to-side length and a front-to-rear width that will frictionally engage the feet of a user positioned at stabilized locations on opposite sides of said pivot plate; said dimensions extending throughout substantially the full planar extend of said upper surface whereby said stabilized locations can be varied to produce a closed kinetic chain exercising of one of a plurality of selected lower extremity joints.

2. A closed kinetic chain exerciser device comprising:

a platform having an upper surface and a lower surface;

a pivot plate connected to said lower surface;

said pivot plate support having a length substantially equal to the distance between the front and rear edges of said platform and including a semi-circular recess therein for supporting said distal end of said pivot plate during opposite tilting movement of said platform; and a cross-member on said pivot plate support and an opening in said pivot plate for receiving said cross-member for preventing fore and aft movement of said platform with respect to said pivot plate support for preventing separation therebetween along the length thereof during tilting movement of said platform;

first and second friction surfaces on said upper surface having a coefficient of friction greater than that of said upper surface; said first friction surface located on said upper surface solely on one side of said pivot plate; said second friction surface located on said upper surface solely on a side of said pivot plate opposite to said one side; said first and second friction surfaces having dimensions including a side-to-side length and a front-to-rear width that will frictionally engage the feet of a user positioned at stabilized locations on opposite sides of said pivot plate; said dimensions extending throughout substantially the full planar extend of said upper surface whereby said stabilized locations can be varied to produce a closed kinetic chain exercising of one of a plurality of selected lower extremity joints;

a pivot plate support having a surface thereon for receiving said pivot plate; said surface and said pivot plate interacting when an unbalanced force is imposed on said platform for allowing side to side angular movement of said platform about said longitudinal axis while limiting fore and aft movement of said platform with respect to said pivot plate support.

3. A closed chain exerciser device as set-forth in claim 1 further comprising:

said first and second friction surfaces each including a pair of planar areas each corresponding to the planar area of the sole of a foot; said planar areas being spaced apart fore and aft on said upper surface.

4. A closed chain exerciser device as set-forth in claim 3 further comprising:

said first and second friction surfaces being formed as by a sheet of material having an exposed surface and a surface portion connected to said upper surface; friction particles on said exposed surface and adhesive material on said surface portion thereof connected to said upper surface.

5. A closed chain exerciser device as set-forth in claim 1 further comprising:

said pivot plate having a length substantially equal to the distance between the front and rear edges of said platform and including a semi-circular surface on the distal end thereof extending along the length thereof;

said pivot plate having a height that is matched to the type of closed kinetic chain exercise to be carried out on said closed chain exerciser device.

6. A closed chain exerciser device as set-forth in claim 5 further comprising:

said first and second friction surfaces each including a pair of planar areas each corresponding to the planar area of the sole of a foot; said planar areas being spaced apart fore and aft on said upper surface.

7. A closed chain exerciser device as set-forth in claim 6 further comprising:

said first and second friction surfaces being formed as a sheet of material having an exposed surface and a surface portion connected to said upper surface; friction particles on said exposed surface and adhesive material on said surface portion thereof connected to said upper surface.

* * * * *